US011198929B2

(12) United States Patent
Toyoda et al.

(10) Patent No.: US 11,198,929 B2
(45) Date of Patent: Dec. 14, 2021

(54) HOT ROLLED STEEL SHEET AND METHOD FOR PRODUCING SAME

(71) Applicant: NIPPON STEEL CORPORATION, Tokyo (JP)

(72) Inventors: Takeshi Toyoda, Tokyo (JP); Tetsuya Hirashima, Tokyo (JP); Riki Okamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 177 days.

(21) Appl. No.: 16/635,936

(22) PCT Filed: Oct. 30, 2018

(86) PCT No.: PCT/JP2018/040344

§ 371 (c)(1),
(2) Date: Jan. 31, 2020

(87) PCT Pub. No.: WO2019/088104

PCT Pub. Date: May 9, 2019

(65) Prior Publication Data

US 2020/0199719 A1 Jun. 25, 2020

(30) Foreign Application Priority Data

Oct. 30, 2017 (JP) ..... JP2017-208948

(51) Int. Cl.
*C22C 38/34* (2006.01)
*C21D 8/02* (2006.01)
(Continued)

(52) U.S. Cl.
CPC ..... *C22C 38/34* (2013.01); *C21D 8/021* (2013.01); *C21D 8/0426* (2013.01); *C22C 38/44* (2013.01);
(Continued)

(58) Field of Classification Search
None
See application file for complete search history.

(56) References Cited

U.S. PATENT DOCUMENTS

2017/0159149 A1 6/2017 Toyoda et al.
2018/0327878 A1 11/2018 Toyoda et al.

FOREIGN PATENT DOCUMENTS

JP 3945367 B2 7/2007
JP 2010-275587 A 12/2010
(Continued)

OTHER PUBLICATIONS

International Search Report for PCT/JP2018/040344 dated Feb. 5, 2019.
(Continued)

*Primary Examiner* — Jenny R Wu
(74) *Attorney, Agent, or Firm* — Birch, Stewart, Kolasch & Birch, LLP

(57) ABSTRACT

Provided is a hot rolled steel sheet comprising a predetermined composition wherein the hot rolled steel sheet comprises a dual structure of, by area fraction, a structural fraction of a martensite phase of 10 to 40% and a structural fraction of a ferrite phase of 60% or more, has an average grain size of ferrite grains of 5.0 μm or less, and has a coverage rate of martensite grains by ferrite grains of more than 60%. Also provided is a method for producing a hot rolled steel sheet comprising rolling a steel sheet wherein the respective rolling loads of the final three rolling stands are 80% or more of an immediately previous rolling stand and an average value of these rolling temperatures is 800 to 950° C., and forcibly cooling, then coiling the steel sheet wherein the forcibly cooling includes cooling started within 1.5 seconds after the rolling ends and cooling the steel sheet by a 30° C./second or more average cooling rate down to 600 to 750° C., natural cooling for 3 seconds or more and 10 seconds or less, and cooling by a 30° C./second or more average cooling rate down to 200° C. or less.

17 Claims, 1 Drawing Sheet

(51) Int. Cl.

| | |
|---|---|
| ***C21D 8/04*** | (2006.01) |
| ***C22C 38/44*** | (2006.01) |
| ***C22C 38/48*** | (2006.01) |
| ***C22C 38/50*** | (2006.01) |

(52) U.S. Cl.
CPC ..... *C22C 38/48* (2013.01); *C22C 38/50* (2013.01); *C21D 2211/008* (2013.01)

(56) References Cited

FOREIGN PATENT DOCUMENTS

| | | | | |
|---|---|---|---|---|
| JP | 2015-86415 | A | | 5/2015 |
| JP | 2015086415 | A | * | 5/2015 |
| WO | WO 2015/181911 | A1 | | 12/2015 |
| WO | WO 2017/085841 | A1 | | 5/2017 |

OTHER PUBLICATIONS

Written Opinion of the International Searching Authority for PCT/JP2018/040344 (PCT/ISA/237) dated Feb. 5, 2019.
English Translation of Written Opinion of the International Searching Authority for PCT/JP2018/040344 (PCT/ISA/237) dated Feb. 5, 2019.

* cited by examiner

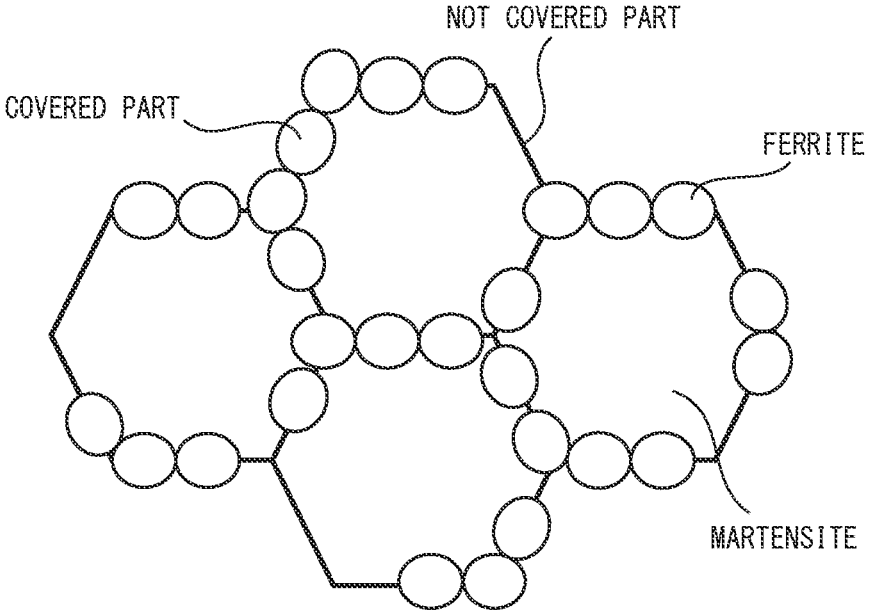
NOT COVERED PART
COVERED PART
FERRITE
MARTENSITE

HOT ROLLED STEEL SHEET AND METHOD FOR PRODUCING SAME

FIELD

The present invention relates to a hot rolled steel sheet with a tensile strength of 980 MPa or more which is excellent in balance of toughness and hole expandability and to a method for producing the same.

BACKGROUND

In recent years, for the purpose of improving the fuel economy and collision safety of automobiles, reduction of the weight of vehicle bodies through use of a high strength steel sheet has been actively pursued. When using the high strength steel sheet, securing press-formability becomes important. Dual phase steel sheet (below, "DP steel sheet") is comprised of a dual phase of a soft ferrite phase and a hard martensite phase. The fact that this has excellent press-formability is generally known. However, DP steel sheet sometimes is formed with voids from the interface between the two phases with their remarkably different hardnesses resulting in cracking, and therefore there is the problem that the hole expandability is inferior. It was not suited for applications requiring a high hole expandability such as suspension parts.

PTL 1 proposes a hot rolled steel sheet able to include ferrite and in addition martensite or bainite etc., which is improved in elongation flangeability as evaluated by the limit hole expandability. Further, PTL 2 proposes to achieve both elongation and hole expandability by a high strength hot rolled steel sheet controlled in coverage rate of martensite grains by ferrite grains and in aspect ratio and average grain size of the ferrite grains.

CITATIONS LIST

Patent Literature

[PTL 1] Japanese Patent No. 3945367
[PTL 2] Japanese Unexamined Patent Publication No. 2015-86415

SUMMARY

Technical Problem

In recent years, due to the orientation toward further reduction of weight of automobiles, the increasing complexity of parts, etc., a high strength hot rolled steel sheet having further higher hole expandability and toughness has been demanded.

PTL 1 describes to perform finish rolling at a temperature of the temperature region from the $Ar_3$ point to the "$Ar_3$ point+100° C." and to start cooling within 0.5 second after the end of that finish rolling so as to cool from the finishing temperature to the "$Ar_3$ point−100° C." by a 400° C./sec or higher average cooling rate. Further, PTL 1 describes that by forcibly cooling after the end of the finish rolling without giving almost any time for air cooling, the ferrite grains become extremely fine grained and the desired texture is formed and that a hot rolled steel sheet with little in-plane anisotropy and excellent workability is obtained. However, in PTL 1, sufficient study has not necessarily been performed from the viewpoint of improvement of the toughness, in particular improvement of the toughness and hole expandability. For this reason, in the hot rolled steel sheet according to PTL 1, there was still room for improvement relative to the material properties.

PTL 2 describes to cause the austenite structures to recrystallize at a rolling stand one stand before a final stage in finish rolling and then introduce a fine amount of strain by light rolling reduction at the grain boundaries of the austenite etc., to control the average grain size and aspect ratio of the ferrite grains covering the martensite grains. It describes that that in the end, a high strength hot rolled steel sheet excellent in balance of elongation and hole expandability is obtained. However, in PTL 2, sufficient study has not necessarily been conducted from the viewpoint of improvement of the toughness, in particular improvement of the toughness and hole expandability. For this reason, in the high strength hot rolled steel sheet described in that PTL 2, there was still room for improvement regarding the material properties.

The present invention has as its object to provide a tensile strength 980 MPa or more hot rolled steel sheet excellent in hole expandability which secures the toughness essential for high strength steel for the above demands while satisfying workability and provide a method for producing the same.

Solution to Problem

Up to now as well, various efforts have been made to suppress the formation of voids occurring at the interface of martensite and ferrite for the improvement of the material of DP steel sheet. Further, to improve the toughness, making the grain size finer to increase the crack propagation paths is generally known, but in a composite structure like DP steel, the effect of the grain size and the effect on the microstructures of martensite and ferrite are not clear. The inventors took note of and intensively studied the nucleation sites and grain growth behavior of ferrite formed in the middle of cooling after hot finish rolling. As a result, they discovered that the average grain size of the ferrite grains covering martensite grains is important for improvement of the material, in particular improvement of both the properties of toughness and hole expandability. Further, as an effect relating to the microstructures of martensite and ferrite, it was learned that by covering the martensite grains, the hole expandability can be improved and further by making the average grain size of the ferrite grains covering the martensite grains finer, it is possible to achieve the suppression of the crack propagation required for improvement of the toughness. However, with the method such as described in PTL 2, i.e., the method of causing recrystallization of the austenite microstructures and then introducing a slight amount of strain by light rolling reduction to the grain boundaries of the austenite, even if the shape and coverage rate of the ferrite can be controlled, since the austenite grains become coarse, the ferrite grains also tend to become coarse. As a result, sometimes it was difficult to reduce the average grain size of the ferrite grains to a fine level. Therefore, the inventors engaged in further study and discovered that by causing dynamic recrystallization of the austenite by hot rolling, it is possible to make the crystal grains of the austenite finer and introduce high dislocation density to the austenite grain boundaries. Specifically, it is necessary to apply large strain in order to cause dynamic recrystallization of the austenite. Therefore, to reliably cause dynamic recrystallization of the austenite in rolling by the rolling stand at the time of finish rolling, it becomes important to hold the respective rolling loads of the final plurality of consecutive rolling stands at 80% or more of the rolling load of the immediately previous rolling stand. By doing so, it is possible to make the crystal grains of austenite finer and introduce high dislocation density into the austenite grain boundaries, and therefore at the time of the subsequent cooling, it is possible to raise the frequency of formation of ferrite formed by nucleation from the austenite grain boundaries to make the formation of fine ferrite grains increase, while it is also possible to make the martensite grains transformed from the austenite grains finer at the time of that cooling. Further, since such fine martensite grains are covered by the above many fine ferrite grains which are similarly formed at the time of cooling, the coverage rate of martensite grains by ferrite grains can be remarkably raised. Due to this, not only is it possible to reliably prevent deterioration of the toughness, which had not necessarily been sufficiently studied in PTLs 1 and 2, but also it becomes possible to achieve both toughness and hole expandability at high levels.

The present invention was made based on the above findings and has as its gist the following:

(1) A hot rolled steel sheet comprising a composition comprising, by mass %,

C: 0.02% or more and 0.50% or less,

Si: 2.0% or less,

Mn: 0.5% or more and 3.0% or less,

P: 0.1% or less,

S: 0.01% or less,

Al: 0.01% or more and 1.0% or less,

N: 0.01% or less, and a balance of Fe and impurities, wherein the hot rolled steel sheet comprises a dual structure of, by area fraction, a structural fraction of a martensite phase of 10% or more and 40% or less, and a structural fraction of a ferrite phase of 60% or more, the hot rolled steel sheet has an average grain size of ferrite grains of 5.0 μm or less, the hot rolled steel sheet has a coverage rate of martensite grains by ferrite grains of more than 60%, and wherein the "coverage rate of martensite grains by ferrite grains" is the ratio of length, expressed by percentage, of martensite grain boundary parts occupied by ferrite grains when the total martensite grain boundary length is 100.

(2) The hot rolled steel sheet according to (1), further comprising, by mass %, one or more of Nb: 0.001% or more and 0.10% or less, Ti: 0.01% or more and 0.20% or less, Ca: 0.0005% or more and 0.0030% or less, Mo: 0.02% or more and 0.5% or less, and Cr: 0.02% or more and 1.0% or less.

(3) The hot rolled steel sheet according to (1) or (2), wherein the average grain size of the ferrite grains is 4.5 μm or less.

(4) The hot rolled steel sheet according to any one of (1) to (3), wherein the coverage rate is 65% or more.

(5) The hot rolled steel sheet according to any one of (1) to (4), wherein the structural fraction of the martensite phase is 10% or more and less than 20%.

(6) A method for producing a hot rolled steel sheet comprising:

casting a slab comprising the composition according to any one of (1) to (5), hot rolling the cast slab wherein the hot rolling includes finish rolling the slab using a rolling mill provided with at least four consecutive rolling stands, the respective rolling loads of the final three rolling stands in the finish rolling are 80% or more of a rolling load of an immediately previous rolling stand, and an average value of finish rolling temperatures of the final three rolling stands is 800° C. or more and 950° C. or less, and forcibly cooling, then coiling the finish rolled steel sheet wherein the forcibly cooling includes primary cooling started within 1.5 seconds after the finish rolling ends and cooling the steel sheet by a 30° C./second or more average cooling rate down to 600° C. or more and 750° C. or less, intermediate air cooling allowing the primary cooled steel sheet to naturally cool for 3 seconds or more and 10 seconds or less, and secondary cooling the intermediate air cooled steel sheet by a 30° C./second or more average cooling rate down to 200° C. or less.

Advantageous Effects of Invention

According to the present invention, since a hot rolled steel sheet excellent in balance of toughness and hole expandability can be provided, a hot rolled steel sheet suitable for pressed parts requiring a high degree of working can be provided. Further, since the hot rolled steel sheet of the present invention has a 980 MPa or more tensile strength and is excellent in balance of toughness and hole expandability to a high level, reduction of the weight of car bodies due to increased thinness of the car body materials in automobiles etc., integral shaping of parts, and shortening of the working process become possible, the fuel efficiency can be improved, the manufacturing costs can be reduced, and the industrial value is high.

BRIEF DESCRIPTION OF DRAWINGS

FIG. 1 is a view of an image for explaining a coverage rate of martensite grains by ferrite grains.

DESCRIPTION OF EMBODIMENTS

<Hot Rolled Steel Sheet>

The present invention takes note of the nucleation sites and behavior of grain growth of the ferrite formed during cooling after hot finish rolling and controls the average grain size of the ferrite grains and the ratio of ferrite grains covering the martensite grains to thereby provide a high strength hot rolled steel sheet excellent in balance of toughness and hole expandability. The hot rolled steel sheet of the present invention is characterized by comprising a predetermined composition, comprising a dual structure of, by area fraction, a structural fraction of a martensite phase of 10% or more and 40% or less and a structural fraction of a ferrite phase of 60% or more, having an average grain size of the ferrite grains of 5.0 μm or less, and having a coverage rate of martensite grains by ferrite grains of more than 60%.

Below, the individual constituent requirements of the present invention will be explained in detail. First, the reasons for limitation of the constituents (composition) of the present invention will be explained. The % for the content of constituents means mass %.

[C: 0.02% or More and 0.50% or Less]

C is an important element determining the strength of steel sheet. To obtain the targeted strength, 0.02% or more must be contained. Preferably the content is 0.03% or more, more preferably 0.04% or more. However, if containing more than 0.50%, the toughness is made to deteriorate, so the upper limit is 0.50%. The C content may also be 0.45% or less or 0.40% or less.

[Si: 2.0% or Less]

Si is effective for raising the strength as a solution strengthening element, but causes deterioration of toughness, so the content is 2.0% or less. Preferably the content is 1.5% or less, more preferably 1.2% or less or 1.0% or less. Si need not be included. That is, the Si content may also be 0%. For example, the Si content may be 0.05% or more, 0.10% or more or 0.20% or more.

[Mn: 0.5% or More and 3.0% or Less]

Mn is effective for hardenability and raising the strength as a solution strengthening element. To obtain the targeted strength, 0.5% or more is necessary. Preferably the content is 0.6% or more. If excessively adding this, MnS, which is harmful to hole expandability, is formed, so the upper limit is 3.0% or less. The Mn content may also be 2.5% or less or 2.0% or less.

[P: 0.1% or Less]

The lower the P, the better. If more than 0.1% is contained, the workability and weldability are detrimentally affected and the fatigue characteristic is also made to fall, so the content is 0.1% or less. Preferably the content is 0.05% or less, more preferably 0.03% or less. The P content may also be 0%, but excessive reduction invites a rise in cost, so preferably the content is 0.0001% or more.

[S: 0.01% or less]

The lower the S, the better. If too great, inclusions of MnS etc., harmful to the isotropy of the toughness are formed, so the content must be 0.01% or less. If a strict low temperature toughness is demanded, the content is preferably 0.006% or less. The S content may also be 0%, but excessive reduction invites a rise in cost, so preferably the content is 0.0001% or more.

[Al: 0.01% or More and 1.0% or Less]

Al is an element required for deoxidation. Normally, 0.01% or more is added. For example, the Al content may also be 0.02% or more or 0.03% or more. However, if excessively adding this, alumina precipitating in clusters is formed and the toughness is made to deteriorate, so the upper limit is 1.0%. For example, the Al content may be 0.8% or less or 0.6% or less.

[N: 0.01% or Less]

N forms coarse Ti nitrides and causes deterioration of the toughness at a high temperature. Therefore, the content is 0.01% or less. For example, the N content may also be 0.008% or less or 0.005% or less. The N content may also be 0%, but excessive reduction invites a rise in cost, so preferably the content is 0.0001% or more.

While not essential for satisfying the demanded characteristics, one or more types of the following elements may also be added for reducing variation in manufacture or further raising the strength and, further, for raising more the toughness and/or hole expandability.

[Nb: 0.001% or More and 0.10% or Less]

Nb can reduce the crystal grain size of the hot rolled steel sheet and raise the strength by NbC. If the content of Nb is 0.001% or more, that effect is obtained. For example, the Nb content may also be 0.01% or more or 0.02% or more. On the other hand, if more than 0.10%, the effect becomes saturated, so the upper limit is 0.10%. For example, the Nb content may be 0.08% or less or 0.06% or less.

[Ti: 0.01% or More and 0.20% or Less]

Ti causes precipitation strengthening of ferrite and slows the transformation rate whereby the controllability is raised, so is an element effective for obtaining the targeted ferrite fraction. To obtain an excellent balance of toughness and hole expandability, 0.01% or more has to be added. However, if adding more than 0.20%, inclusions due to TiN are formed and the hole expandability is degraded, so the content of Ti is 0.01% or more and 0.20% or less. For example, the Ti content may also be 0.02% or more or 0.03% or more and may also be 0.15% or less or 0.10% or less.

[Ca: 0.0005% or More and 0.0030% or Less]

Ca is an element suitable for causing dispersion of a large number of fine oxide particles and making the structure finer in the deoxidation of the molten steel and, further, is an element immobilizing the S in the steel as spheroidal CaS in the desulfurization of the molten steel and suppressing the formation of MnS and other stretched inclusions to thereby improve the hole expandability. These effects are obtained with an amount of addition from 0.0005%, but become saturated at 0.0030%, so the content of Ca is 0.0005% or more and 0.0030% or less. For example, the Ca content may also be 0.0010% or more or 0.0015% or more and may also be 0.0025% or less.

[Mo: 0.02% or More and 0.5% or Less]

Mo is an element effective for precipitation strengthening of ferrite. To obtain this effect, addition of 0.02% or more is preferable. For example, the Mo content may also be 0.05% or more or 0.10% or more. However, addition of a large amount would result in the crack sensitivity of the slab rising and would make handling of the slab difficult, so the upper limit is 0.5%. For example, the Mo content may also be 0.4% or less or 0.3% or less.

[Cr: 0.02% or More and 1.0% or Less]

Cr is an element effective for improving the steel sheet strength. To obtain this effect, 0.02% or more must be added. For example, the Cr content may also be 0.05% or more or 0.10% or more. However, addition of a large amount causes the ductility to fall, so the upper limit is 1.0%. For example, the Cr content may also be 0.8% or less or 0.5% or less.

In the hot rolled steel sheet of the present invention, the balance of the composition besides the above constituents is comprised of Fe and impurities. Here, "impurities" are constituents which enter when industrially producing the hot rolled steel sheet due to the starting materials such as the ore or scraps and various other factors in the manufacturing process and encompass constituents not intentionally added to the hot rolled steel sheet of the present invention. Further, "impurities" encompass elements, other than the constituents explained above, which are contained in the hot rolled steel sheet at a level by which the actions and effects distinctive of the elements do not affect the characteristics of the hot rolled steel sheet according to the present invention.

Next, the crystal structure of the hot rolled steel sheet of the present invention will be explained.

[Dual Structure with Structural Fraction of Martensite Phase of 10% or More and 40% or Less and Structural Fraction of Ferrite Phase of 60% or More]

The hot rolled steel sheet of the present invention includes a dual structure of a martensite phase and a ferrite phase. Here, in the present invention, a "dual structure" means a structure in which the total of the martensite phase and ferrite phase is an area ratio of 90% or more. For the balance, pearlite and bainite may be included.

In the steel sheet containing the above dual structure, hard microstructures of martensite are dispersed in soft ferrite excellent in elongation. Due to this, while being a high strength, a high elongation is realized. However, in such a steel sheet, high strain concentrates near the hard microstructures and the crack propagation rate becomes faster, so there is the defect that the hole expandability becomes lower. For this reason, while numerous studies have been conducted on the fractions of the ferrite and martensite phases and the sizes of martensite grains, there are almost zero examples of proactively controlling the sizes of the ferrite grains and the arrangement of ferrite grains covering the martensite grains so as to study the possibility of improvement of the material of the steel sheet. The present invention suitably controls the average grain size of the ferrite grains and the arrangement of ferrite grains covering the martensite grains in a dual structure comprised of a martensite phase and a ferrite phase so as to provide a high strength hot rolled steel sheet excellent in balance of toughness and hole expandability. According to the present invention, the hot rolled steel sheet has to contain, by area fraction of steel sheet microstructure, a martensite phase in 10% or more and 40% or less and a ferrite phase in 60% or more. For example, the martensite phase may be present by an area fraction of 12% or more or 14% or more and may be contained in 35% or less or 30% or less. Further, the ferrite phase may be present by an area fraction of 70% or more or more than 80%. The upper limit is 90% or less or 85% or less. In particular, the fraction of the martensite phase where the balance between the toughness and the hole expandability is excellent is 10% or more and less than 20% or 18% or less. If the fraction of the martensite phase becomes less than 10%, the average grain size of the ferrite grains inevitably becomes large and the toughness falls. If the fraction of the martensite phase becomes more than 40%, the martensite phase, which are poor in ductility, become the main phase, so the hole expandability falls. With a fraction of the ferrite phase of less than 60%, the strain caused by the ferrite grains is not sufficiently eased. Further, workability cannot be secured, so it becomes no longer possible to achieve both toughness and hole expandability at a high level.

In the present invention, the structural fractions of the ferrite phase and martensite phase are determined in the following way. First, a sample is taken using a cross-section of sheet thickness parallel to the rolling direction of the hot rolled steel sheet as the observed surface. The observed surface is polished and then corroded by Nital and LePera's reagent or another reagent, then analyzed by image analysis using a field emission type scan electron microscope (FE-SEM) or other optical microscope. More specifically, the structure at the ¼ position of sheet thickness is observed by a power of 1000× by an optical microscope and then analyzed by image analysis by 100×100 μm fields. The averages of these measured values in 10 fields or more are determined as the structural fractions of the ferrite phase and martensite phase.

[Coverage Rate of Martensite Grains by Ferrite Grains of More than 60%]

In the present invention, one of the most important features is the arrangement of ferrite grains. In the present invention, the ferrite grains are arranged in a manner surrounding the martensite grains. FIG. 1 is a view of an image for explaining the coverage rate of martensite grains by ferrite grains. As shown in FIG. 1, the ratio of the parts of the martensite grain boundaries occupied by ferrite grains to the total martensite grain boundary length is defined as the "coverage rate". In the present invention, the total martensite grain boundary length and the length of the parts occupied by the ferrite grains are determined using an optical microscope and, for example, can be quantitatively found using electron backscatter diffraction (EBSD). In the present invention, the coverage rate of martensite grains by ferrite grains is calculated by randomly selecting 100×100 μm fields in a structure at ¼ position of sheet thickness, examining 500 or more martensite grains at 10 fields or more using an EBSD or other optical microscope to find the total martensite grain boundary length (total of "total of outer circumferential lengths of ferrite grains corresponding to martensite grain boundary parts occupied by ferrite grains" and "lengths of martensite grain boundary parts not occupied by ferrite grains") and length of parts occupied by the ferrite grains ("total of outer circumferential lengths of ferrite grains corresponding to martensite grain boundary parts occupied by ferrite grains"). If the coverage rate of martensite grains by ferrite grains is more than 60%, the linkage ability of ferrite is enhanced and it is possible to suppress the formation of voids at the time of working, so the toughness and hole expandability are improved. If the coverage rate is low, the linkage of the ferrite becomes lower, i.e., the gaps between the ferrite grains covering the martensite grains become greater and at the time of working, stress concentrates at such gaps and may cause cracking, so the coverage rate is preferably a higher value, for example, may be 65% or more, 68% or more, or 70% or more. In shaping where more severe working is received, 70% or more is preferable. Further, the coverage rate may also be 100%, for example, 98% or less or 95% or less.

[Average Grain Size of Ferrite Grains of 5.0 μm or Less]

On the other hand, when making the fraction of the ferrite phase increase so as to raise the coverage rate, if the average grain size of the ferrite grains becomes larger, the toughness becomes inferior. For this reason, the average grain size of the ferrite grains has to be 5.0 μm or less. For example, the average grain size of the ferrite grains may be 0.5 μm or more or 1.0 μm or more and/or 4.5 μm or less, 4.0 μm or less, 3.5 μm or less, or 3.0 μm or less, preferably, 0.5 μm or more and 3.0 μm or less. Therefore, refining the ferrite grains by making the nucleation sites in ferrite transformation increase becomes important. Note that, in the present invention, the average grain size of the ferrite grains is measured using an EBSD in the following way. As the EBSD, for example, an apparatus comprised of an FE-SEM and an EBSD detector is used. The structure at ¼ position of sheet thickness is examined by a 1000× power and is analyzed by image analysis at 100×100 μm fields. Next, boundaries with an angular difference of crystal grain boundaries of 5° or more are deemed grain boundaries and the regions surrounded by the grain boundaries are deemed "crystal grains". The grain sizes of the ferrite grains are measured by circle equivalent diameters. The average of measured values at 10 fields or more is defined as the "average grain size of the ferrite grains".

In the hot rolled steel sheet of the present invention, as explained above, not only the ferrite grains, but also the martensite grains can be made finer. The average grain size of the martensite grains is not particularly limited, but, for example, may be 1.0 μm or more, 3.0 μm or more, or 6.0 μm or more and/or may be 20.0 μm or less, 18.0 μm or less, 15.0 μm or less, or 10.0 μm or less. In FIG. 1, an aspect where the martensite grains are larger than the ferrite grains is illustrated, but the hot rolled steel sheet of the present invention is not limited to such an aspect. The case where the average grain size of the ferrite grains is larger than the average grain size of the martensite grains is also included.

<Method for Producing Hot Rolled Steel Sheet>

Next, the method for producing the hot rolled steel sheet of the present invention will be explained.

The hot rolled steel sheet of the present invention can be produced by a method comprising casting a slab comprising the same composition as the hot rolled steel sheet, hot rolling the cast slab wherein the hot rolling includes finish rolling the slab using a rolling mill provided with at least four consecutive rolling stands, the respective rolling loads of the final three rolling stands in the finish rolling are 80% or more of a rolling load of an immediately previous rolling stand, and an average value of finish rolling temperatures of the final three rolling stands is 800° C. or more and 950° C. or less, and forcibly cooling, then coiling the finish rolled steel sheet wherein the forcibly cooling includes primary cooling started within 1.5 seconds after the finish rolling ends and cooling the steel sheet by a 30° C./second or more average cooling rate down to 600° C. or more and 750° C. or less, intermediate air cooling allowing the primary cooled steel sheet to naturally cool for 3 seconds or more and 10 seconds or less, and secondary cooling the intermediate air cooled steel sheet by a 30° C./second or more average cooling rate down to 200° C. or less.

Such a method for production can be performed using various rolling techniques known to persons skilled in the art. While not particularly limited, for example, the method is preferably performed by endless rolling etc., where the casting to the rolling are linked together. By performing endless rolling, in the finish rolling, high load rolling described below becomes possible.

[Slab Casting]

The casting of the slab is not limited to any specific method. To obtain a slab having the same composition as explained above for the hot rolled steel sheet of the present invention, the steel may be smelted by a blast furnace, electrical furnace, etc., then refined by various types of secondary refining, adjusted in chemical composition, and then cast by the usual continuous casting or ingot casting. Further, it may also be cast by thin slab casting or other method. Note that, scrap may also be used as a material of the cast slab, but the chemical composition must be adjusted.

[Hot Rolling]

According to the present invention, the cast slab is next hot rolled. This hot rolling includes finish rolling the cast slab using a tandem rolling mill or other rolling mill provided with at least four consecutive rolling stands so that the respective rolling loads of the final three rolling stands become 80% or more of the rolling loads of the immediately previous rolling stand. By consecutively applying high loads to the slab at the final three rolling stands in the finish rolling, it is possible to cause dynamic recrystallization of austenite in the steel sheet, whereby the crystal grains of austenite can be made finer and high dislocation density can be introduced at the austenite grain boundaries. As a result, it is possible to raise the frequency of formation of ferrite formed by nucleation from the austenite grain boundaries at the time of the subsequent forcible cooling to thereby increase the formation of fine ferrite grains. On the other hand, the martensite grains transformed from the austenite grains at the time of the forcible cooling can be refined. Further, such martensite grains are similarly covered by the above large amount of fine ferrite grains formed at the time of forcible cooling, so the coverage rate of martensite grains by ferrite grains can also be remarkably raised.

If the respective rolling loads of the final three rolling stands are less than 80% of the rolling load of the immediately previous rolling stand, static recrystallization and recovery are promoted between rolling passes of the rolling stands and the strain required for dynamic recrystallization cannot be built up. Explaining this in more detail, for example, even if hot rolling by a higher rolling reduction at each rolling stand, if the time between the rolling passes becomes longer, the strain introduced at the rolling passes will end up being recovered from before the next rolling passes. As a result, it becomes no longer possible to build up the strain required for dynamic recrystallization. Therefore, if controlling the hot rolling by the rolling reduction, it becomes necessary to strictly control the time between passes to a specific short time. Further, even if strictly controlling the time between passes to a specific short time, if the rolling reduction at any of the final three rolling stands is low, only naturally an 80% or more rolling load cannot be satisfied, so similarly it becomes no longer possible to build up the strain required for dynamic recrystallization. In contrast to this, in the method for producing the hot rolled steel sheet of the present invention, by controlling the hot rolling not by the rolling reduction, but by the rolling load, it becomes possible to reliably build up strain. More specifically, along with the buildup of strain, the load required for rolling becomes higher. Therefore, by controlling the hot rolling to within a specific range of rolling load, it becomes possible to reliably build up the strain required for dynamic recrystallization and control the built-up amount. The upper limit of the rolling load is not particularly limited, but if more than 120% of the rolling load of the immediately previous rolling stand, it becomes difficult to form the sheet shape, sheet fracture between rolling passes increases, and other manufacturing problems are caused. Therefore, the rolling load is 80% or more, preferably 85% or more, and/or 120% or less, preferably 100% or less. In general, the later the rolling stand, the greater the effect on strain buildup. Therefore, if not possible to achieve an 80% or more rolling load at the last rolling stand among the final three rolling stands, the average grain size of the ferrite grains tends to become greater and the coverage rate of martensite grains by ferrite grains tends to become smaller. Further, speaking from the viewpoint of the rolling reduction, while not particularly limited, the hot rolling according to the method of the present invention is performed so that the rolling reduction by the final rolling stand becomes generally 25% or more, preferably 25 to 40%, in range.

In addition, the temperature at the time of the finish rolling (finish rolling temperature) is also important in the method of the present invention. Specifically, the lower the average value of the finish rolling temperatures at the final three rolling stands, the more finely the size of the martensite grains can be made at the time of forcible cooling and the higher the dislocation density that can be introduced to the grain boundaries. However, if the average value of these finish rolling temperatures is too low, the ferrite transformation proceeds too rapidly and a structural fraction of martensite phase of 10% or more can no longer be secured. On the other hand, if this average value is high, the dislocation density of the austenite grain boundaries decreases and the coverage rate falls. Due to the above, the average value of the finish rolling temperatures at the final three rolling stands is 800° C. or more and 950° C. or less. In the hot rolling by the final three rolling stands in the present invention, the rolling load is high, so the heat generated by working etc., sometimes cause the temperature to rise. Such a high temperature is advantageous for realization of dynamic recrystallization. On the other hand, if the temperature becomes high at a later stage, it would become disadvantageous for buildup of strain, so the temperature after rolling by the final rolling stand (finish rolling end temperature), while not particularly limited, is preferably, for example, 850° C. or more. Further, the finish rolling end temperature may, for example, be 1000° C. or less.

(Rough Rolling)

In the method of the present invention, for example, to adjust the sheet thickness etc., the cast slab may also be rough rolled before the finish rolling. Such rough rolling is not particularly limited, but, for example, may be performed by reheating the cast slab, directly or after once cooling, in accordance with need so as to homogenize the steel and dissolve Ti carbonitrides etc. If reheating, with a temperature of less than 1200° C., the homogenization and dissolution both become insufficient and a drop in strength or drop in workability is sometimes caused. On the other hand, if the temperature of the reheating is more than 1350° C., the manufacturing cost rises and productivity falls and, further, the initial austenite grain size becomes larger whereby finally dual grains are easily formed. Therefore, the temperature for reheating for homogenization and/or dissolution of Ti carbonitrides etc., is preferably 1200° C. or more and preferably less than 1350° C.

[Forcible Cooling and Coiling]

After the finish rolling ends, the forcible cooling should be quickly performed. In the period from the end of the finish rolling to the start of the forcible cooling, strain recovery and grain growth occur, whereby both the ferrite grains and austenite grains produced due to the transformation at the time of subsequent forcible cooling easily become coarse. Furthermore, the dislocation density of the austenite grain boundaries introduced due to the dynamic recrystallization at the time of the finish rolling decreases, so at the time of the subsequent forcible cooling, sometimes the coverage rate of martensite grains by ferrite grains falls. The amount of strain recovery up to the start of forcible cooling can change according to the rolling temperature and the rolling rate, but if the time from the end of the finish rolling to the start of the forcible cooling is within 1.5 seconds, it is possible to prevent complete recovery. For effective utilization of strain due to rolling, the time is preferably within 1 second. After the finish rolling ends, as primary cooling, the sheet is cooled by an average cooling rate of 30° C./second or more down to 600° C. or more and 750° C. or less, and then cooled for 3 seconds or more and 10 seconds or less (below, referred to as "intermediate air cooling"). During this time, ferrite is formed. Due to the dispersion of C, C concentrates at the austenite. Due to formation of this ferrite, the ductility is improved. In addition, the C concentrating at the austenite is important for contributing to the strength of the martensite by subsequent forcible cooling. With an average cooling rate of less than 30° C./second, coarsening of the austenite grains occurs, ferrite transformation at the time of intermediate air cooling is delayed, and the targeted structural fraction of the ferrite phase can no longer be obtained. If the intermediate air cooling start temperature exceeds 750° C., the structural fraction of the ferrite phase can no longer be sufficiently obtained. Further, the grains become too large. The final martensite grains also easily become larger. With an intermediate air cooling start temperature of less than 600° C. or an intermediate air cooling time of less than 3 seconds, a predetermined structural fraction of the ferrite phase cannot be obtained and the structural fraction of the martensite phase also becomes higher. On the other hand, if the intermediate air cooling time exceeds 10 seconds, the structural fraction of the martensite phase becomes lower. From the viewpoint of securing the structural fraction of the martensite phase, 8 seconds or less is preferable.

To cause austenite at which C is concentrated to transform to martensite, after intermediate air cooling, it is important to cool the steel down to 200° C. or less as secondary cooling, then coil it up. The average cooling rate at this time has to be 30° C./second or more. If the coiling temperature exceeds 200° C., during coiling, a bainite phase and/or pearlite phase are formed and the elongation falls. Along with this, a dual structure of a ferrite phase and martensite phase is sometimes no longer obtained. When the average cooling rate is less than 30° C./second, during cooling, a bainite phase and/or pearlite phase are formed and a dual structure of a ferrite phase and martensite phase can no longer be obtained.

By casting a slab having a composition the same as that explained for the hot rolled steel sheet of the present invention, then rough rolling as needed, then, as explained above, performing finish rolling and the subsequent forcible cooling and coiling operations, it is possible to reliably produce a hot rolled steel sheet including a dual structure of, by area fraction, a structural fraction of a martensite phase of 10% or more and 40% or less and a structural fraction of a ferrite phase of 60% or more, having an average grain size of the ferrite grains of 5.0 μm or less, and having a coverage rate of martensite grains by ferrite grains of more than 60%. For this reason, according to the above method for production, it becomes possible to provide a tensile strength 980 MPa or more high strength hot rolled steel sheet excellent in balance of toughness and hole expandability.

Below, examples will be used to explain the present invention in more detail, but the present invention is not limited to these examples in any way.

EXAMPLES

Using a facility for consecutively processing steel containing the chemical constituents shown in Table 1 from casting to rolling, each slab was cast, then rough rolled and finished rolled, then cooled by primary cooling, intermediate air cooling, and secondary cooling, then coiled up to thereby produce a hot rolled steel sheet. The balances besides the constituents shown in Table 1 were Fe and impurities. Further, samples taken from the produced hot rolled steel sheets were analyzed. The chemical constituents thus analyzed were equivalent to the chemical constituents of the steels shown in Table 1.

TABLE 1

| Chemical Constituents | | | | | | | | | | | | |
|---|---|---|---|---|---|---|---|---|---|---|---|---|
| | Constituents (mass %) | | | | | | | | | | | |
| Steel type | C | Si | Mn | P | S | Al | N | Nb | Ti | Ca | Mo | Cr |
| A | 0.04 | 0.30 | 0.6 | 0.015 | 0.0030 | 0.22 | 0.004 | — | — | — | — | — |
| B | 0.04 | 0.20 | 0.6 | 0.014 | 0.0042 | 0.03 | 0.004 | 0.02 | — | — | — | — |
| C | 0.12 | 1.00 | 1.0 | 0.014 | 0.0030 | 0.03 | 0.003 | 0.02 | 0.04 | 0.002 | — | — |
| D | 0.25 | 0.90 | 1.4 | 0.015 | 0.0010 | 0.03 | 0.004 | — | 0.10 | — | — | — |
| E | 0.25 | 0.90 | 1.4 | 0.015 | 0.0013 | 0.03 | 0.003 | — | 0.06 | 0.002 | 0.2 | — |
| F | 0.35 | 1.20 | 1.8 | 0.014 | 0.0030 | 0.52 | 0.004 | — | — | — | — | 0.3 |
| G | 0.35 | 1.20 | 1.8 | 0.013 | 0.0060 | 0.55 | 0.003 | 0.02 | 0.06 | — | 0.3 | — |
| H | 0.65 | 0.80 | 2.3 | 0.015 | 0.0050 | 0.10 | 0.004 | — | 0.06 | — | — | — |
| I | 0.07 | 1.00 | 4.2 | 0.015 | 0.0030 | 0.52 | 0.004 | 0.02 | — | 0.002 | — | — |

In the table, "—" fields show corresponding constituents not deliberately added.

TABLE 2

| Rolling Conditions | | | | | | | |
|---|---|---|---|---|---|---|---|
| No. | Steel type | F3 load rate, % | F4 load rate, % | F5 load rate, % | Average finish rolling temp., ° C. | Cooling start, sec. | Primary cooling, ° C./sec. |
| 1 | A | 88 | 90 | 88 | 888 | 0.6 | 110 |
| 2 | A | 82 | 85 | 85 | 782 | 1.0 | 64 |
| 3 | A | 80 | 81 | 89 | 895 | 0.5 | 105 |
| 4 | A | 89 | 84 | 90 | 915 | 1.5 | 50 |
| 5 | A | 90 | 91 | 90 | 967 | 1.2 | 80 |
| 6 | B | 85 | 85 | 88 | 911 | 0.9 | 89 |
| 7 | B | 86 | 91 | 91 | 939 | 1.0 | 70 |
| 8 | B | 88 | 89 | 84 | 913 | 1.3 | 93 |
| 9 | B | 81 | 86 | 90 | 900 | 1.3 | 83 |
| 10 | C | 87 | 89 | 87 | 895 | 0.7 | 74 |
| 11 | C | 90 | 89 | 87 | 885 | 1.1 | 115 |
| 12 | C | 88 | 92 | 91 | 921 | 2.3 | 50 |
| 13 | C | 86 | 82 | 91 | 928 | 1.0 | 89 |
| 14 | C | 81 | 85 | 88 | 892 | 1.2 | 139 |
| 15 | D | 81 | 94 | 89 | 929 | 1.0 | 115 |
| 16 | D | 81 | 86 | 87 | 918 | 0.8 | 73 |
| 17 | D | 87 | 82 | 87 | 855 | 0.7 | 72 |
| 18 | D | 90 | 86 | 89 | 919 | 0.6 | 80 |
| 19 | E | 80 | 94 | 85 | 891 | 1.1 | 40 |
| 20 | E | 91 | 84 | 86 | 929 | 0.6 | 15 |
| 21 | E | 91 | 92 | 87 | 861 | 0.7 | 90 |
| 22 | E | 82 | 84 | 88 | 862 | 0.9 | 63 |
| 23 | F | 83 | 91 | 85 | 918 | 0.7 | 46 |
| 24 | F | 81 | 81 | 75 | 880 | 0.5 | 100 |
| 25 | F | 89 | 89 | 85 | 878 | 0.7 | 78 |
| 26 | F | 83 | 90 | 84 | 878 | 0.9 | 108 |
| 27 | G | 86 | 68 | 90 | 868 | 0.7 | 45 |
| 28 | G | 89 | 85 | 89 | 886 | 1.0 | 93 |
| 29 | G | 73 | 93 | 86 | 912 | 0.8 | 123 |
| 30 | H | 83 | 94 | 84 | 896 | 1.0 | 113 |
| 31 | I | 87 | 93 | 87 | 900 | 1.0 | 116 |
| 32 | G | 92 | 95 | 78 | 921 | 0.8 | 82 |

| No. | Interm, temp., ° C. | Interm, time, sec. | Secondary cooling, ° C./sec. | Coiling temp., ° C. | Sheet thick., mm |
|---|---|---|---|---|---|
| 1 | 653 | 6 | 127 | 100 | 2.3 |
| 2 | 656 | 9 | 44 | 100 | 2.3 |
| 3 | 686 | 1 | 120 | 100 | 2.3 |
| 4 | 728 | 9 | 57 | 100 | 2.3 |
| 5 | 726 | 7 | 113 | 100 | 2.3 |
| 6 | 668 | 4 | 121 | 100 | 2.6 |
| 7 | 681 | 6 | 55 | 100 | 2.6 |
| 8 | 802 | 9 | 117 | 100 | 2.6 |
| 9 | 721 | 3 | 107 | 150 | 2.6 |
| 10 | 682 | 7 | 72 | 150 | 2.6 |
| 11 | 739 | 8 | 84 | 150 | 2.6 |
| 12 | 699 | 7 | 53 | 150 | 2.6 |
| 13 | 712 | 6 | 90 | 150 | 2.6 |
| 14 | 679 | 12 | 142 | 150 | 3.2 |
| 15 | 722 | 3 | 101 | 150 | 3.2 |
| 16 | 659 | 7 | 109 | 150 | 3.2 |
| 17 | 553 | 6 | 46 | 150 | 3.2 |
| 18 | 653 | 5 | 99 | 150 | 3.2 |
| 19 | 732 | 3 | 39 | 150 | 4.8 |
| 20 | 718 | 5 | 56 | 150 | 4.8 |
| 21 | 701 | 9 | 101 | 150 | 4.8 |
| 22 | 643 | 7 | 63 | 100 | 4.8 |
| 23 | 651 | 7 | 20 | 100 | 4.8 |
| 24 | 681 | 8 | 109 | 100 | 4.8 |
| 25 | 676 | 10 | 127 | 100 | 2.3 |
| 26 | 643 | 7 | 87 | 100 | 2.3 |
| 27 | 666 | 7 | 89 | 100 | 2.6 |
| 28 | 720 | 6 | 72 | 100 | 2.6 |
| 29 | 684 | 5 | 83 | 100 | 2.3 |
| 30 | 676 | 3 | 103 | 100 | 3.2 |
| 31 | 658 | 7 | 71 | 100 | 2.6 |
| 32 | 653 | 4 | 110 | 100 | 2.3 |

Table 2 shows the steel type nos., finish rolling conditions, and thickness of steel sheets used. In Table 2, the "F3 load rate", "F4 load rate", and "F5 load rate" mean the ratios of the respective rolling loads of the final three rolling stands in a rolling mill provided with five consecutive finish rolling stands with respect to the rolling loads of the immediately previous rolling stand and show the values relating to the third, fourth, and final rolling stand. Further, in Table 2, the "average finish rolling temperature" is the average value of the finish rolling temperatures at the final three rolling stands, the "cooling start" is the time from when the finish rolling is ended to the start of the primary cooling, the "primary cooling" is the average cooling rate from when ending the finish rolling to the intermediate air cooling start temperature, the "intermediate temperature" is the intermediate air cooling start temperature after primary cooling, the "intermediate time" is the intermediate air cooling time after primary cooling, the "secondary cooling" is the average cooling rate from after intermediate air cooling to when the coiling is started, and the "coiling temperature" is the temperature after the end of secondary cooling. While not shown in Table 2, in all of the examples according to the present invention (except comparative examples), the finish rolling end temperature was 850° C. or more. Further, in all of the examples according to the present invention (except comparative examples), the rolling reduction by the final rolling stand was 25% or more.

The thus obtained hot rolled steel sheet was examined under an optical microscope to investigate the structural fractions of a ferrite phase and martensite phase, the average grain size of the ferrite grains, and the coverage rate of martensite grains by ferrite grains.

The coverage rate was found by randomly selecting 100×100 μm fields in the structure at ¼ position of sheet thickness, using EBSD to find the total martensite grain boundary length and the length of the martensite grain boundary parts occupied by ferrite grains for 500 martensite grains in 10 fields, and calculating the ratio of length of the martensite grain boundary parts occupied by ferrite grains when defining the total martensite grain boundary length as 100.

The structural fraction of the ferrite phase and average grain size of the ferrite grains of the hot rolled steel sheet are found by obtaining a sample using the cross-section of sheet thickness parallel to the rolling direction of the hot rolled steel sheet as the examined surface, polishing the examined surface and corroding it by Nital, then using an FE-SEM for image analysis of 100×100 μm fields. Further, the structural fraction of the martensite phase is similarly found by obtaining a sample using the cross-section of sheet thickness parallel to the rolling direction of the hot rolled steel sheet as the examined surface, polishing the examined surface and corroding it by LePera's reagent, then using an FE-SEM for image analysis of 100×100 μm fields. More specifically, the average grain size of the ferrite grains and the structural fractions of the ferrite phase and martensite phase were obtained by examining the structure at the ¼ position of sheet thickness by a power of 1000× by an FE-SEM, analyzing the images of 100×100 μm fields, measuring the average grain size of the ferrite grains and the area fractions of the ferrite phase and martensite phase, and defining the averages of these measured values in 10 fields as respectively the average grain size of the ferrite grains and the structural fractions of the ferrite phase and martensite phase. Note that, the average grain size of the ferrite grains was calculated by the circle equivalent diameters.

In the tensile test of the hot rolled steel sheet, a JIS No. 5 test piece was taken in the rolling width direction (C-direction) of the hot rolled steel sheet and was evaluated for yield strength: YP (MPa), tensile strength: TS (MPa), and elongation: EL (%). The case where the tensile strength TS is 980 MPa or more was deemed "passing".

The hole expandability was evaluated by measuring the hole expansion ratio λ (%) in accordance with the method prescribed in ISO 16630.

The toughness was evaluated by conducting a Charpy impact test by a 2.5 mm subsize V-notch test piece prescribed in JIS Z2242 and measuring a ductile-brittle transition temperature. Specifically, the temperature at which the brittle fracture rate became 50% was made the ductile-brittle transition temperature. Further, steel sheets with a final sheet thickness of less than 2.5 mm were measured for their entire thicknesses. The lower the ductile-brittle transition temperature, the more the toughness rises. In the present invention, a case where the ductile-brittle transition temperature is −40° C. or less can be evaluated as being excellent in toughness.

The results of evaluation of the microstructure and material quality of the obtained hot rolled steel sheets are shown in Table 3. In Table 3, "area ratios of microstructure" are the area fractions (structural fractions) of the ferrite phase, martensite phase, and other phases (mainly the bainite phase), "α grain size" is the average grain size of the ferrite grains, and "coverage rate" is the ratio of length of martensite grain boundary parts occupied by ferrite grains expressed as a percentage when the total martensite grain boundary length is defined as 100.

TABLE 3

Results of Evaluation of Structure and Material

| No. | Steel type | Area ratios of microstructure (%) Ferrite | Martensite | Others | α grain size, μm | M grain size, μm | Coverage rate, % | Yield strength, MPa | Tensile strength, MPa |
|---|---|---|---|---|---|---|---|---|---|
| 1 | A | 62 | 38 | 0 | 1.6 | 1.1 | 86 | 725 | 998 |
| 2 | A | 95 | 5 | 0 | 8.3 | 9.1 | 87 | 592 | 784 |
| 3 | A | 15 | 85 | 0 | 0.5 | 0.6 | 84 | 711 | 997 |
| 4 | A | 74 | 26 | 0 | 3.2 | 2.5 | 78 | 727 | 1013 |
| 5 | A | 62 | 38 | 0 | 2.4 | 3.2 | 45 | 751 | 1044 |
| 6 | B | 83 | 17 | 0 | 2.9 | 2.6 | 69 | 765 | 1029 |
| 7 | B | 63 | 37 | 0 | 4.0 | 5.6 | 69 | 821 | 1165 |
| 8 | B | 42 | 58 | 0 | 2.8 | 2.8 | 82 | 735 | 992 |
| 9 | B | 86 | 14 | 0 | 3.8 | 5.4 | 86 | 721 | 1018 |
| 10 | C | 79 | 21 | 0 | 2.1 | 2.5 | 72 | 903 | 1225 |
| 11 | C | 70 | 30 | 0 | 0.7 | 0.8 | 89 | 725 | 996 |
| 12 | C | 80 | 20 | 0 | 6.8 | 4.8 | 69 | 746 | 1060 |
| 13 | C | 89 | 11 | 0 | 0.8 | 0.7 | 78 | 768 | 1050 |
| 14 | C | 98 | 2 | 0 | 10.1 | 8.1 | 80 | 796 | 1093 |
| 15 | D | 74 | 26 | 0 | 3.9 | 5.1 | 82 | 803 | 1106 |
| 16 | D | 64 | 36 | 0 | 1.6 | 2.2 | 74 | 956 | 1320 |

TABLE 3-continued

Results of Evaluation of Structure and Material

| | | | | | | | | | |
|---|---|---|---|---|---|---|---|---|---|
| 17 | D | 54 | 46 | 0 | 1.5 | 1.8 | 84 | 767 | 1249 |
| 18 | D | 75 | 25 | 0 | 0.5 | 0.7 | 86 | 747 | 1038 |
| 19 | E | 86 | 14 | 0 | 1.5 | 1.2 | 73 | 781 | 1096 |
| 20 | E | 55 | 45 | 0 | 7.3 | 6.6 | 75 | 863 | 1229 |
| 21 | E | 75 | 25 | 0 | 2.5 | 3.2 | 92 | 721 | 1018 |
| 22 | E | 61 | 39 | 0 | 3.2 | 3.5 | 84 | 721 | 1013 |
| 23 | F | 75 | 5 | 20 | 8.2 | 5.7 | 69 | 767 | 1085 |
| 24 | F | 70 | 30 | 0 | 9.3 | 8.4 | 53 | 793 | 1093 |
| 25 | F | 82 | 18 | 0 | 1.0 | 1.4 | 71 | 929 | 1311 |
| 26 | F | 80 | 20 | 0 | 3.6 | 5.0 | 88 | 1024 | 1450 |
| 27 | G | 68 | 32 | 0 | 8.1 | 8.1 | 41 | 1008 | 1432 |
| 28 | G | 84 | 16 | 0 | 1.7 | 2.2 | 73 | 941 | 1310 |
| 29 | G | 86 | 14 | 0 | 1.8 | 1.8 | 58 | 953 | 1128 |
| 30 | H | 76 | 24 | 0 | 1.1 | 1.5 | 80 | 745 | 1003 |
| 31 | I | 64 | 36 | 0 | 4.8 | 4.3 | 83 | 731 | 1002 |
| 32 | G | 76 | 24 | 0 | 7.2 | 9.2 | 55 | 881 | 1182 |

| No. | Elongation, % | Hole expansion rate, % | Ductile-brittle transition temp., ° C. | Formula 1 | Remarks |
|---|---|---|---|---|---|
| 1 | 23 | 117 | −74 | −8.7 | Ex. 1 |
| 2 | 23 | 95 | −10 | −1.2 | Comp. Ex. 2 |
| 3 | 17 | 32 | −76 | −2.4 | Comp. Ex. 3 |
| 4 | 15 | 97 | −51 | −4.9 | Ex. 4 |
| 5 | 21 | 29 | −20 | −0.6 | Comp. Ex. 5 |
| 6 | 16 | 103 | −90 | −9.0 | Ex. 6 |
| 7 | 15 | 87 | −90 | −6.7 | Ex. 7 |
| 8 | 23 | 23 | −76 | −1.8 | Comp. Ex. 8 |
| 9 | 19 | 90 | −83 | −7.4 | Ex. 9 |
| 10 | 21 | 128 | −100 | −10.4 | Ex. 10 |
| 11 | 15 | 120 | −81 | −9.7 | Ex. 11 |
| 12 | 16 | 53 | −34 | −1.7 | Comp. Ex. 12 |
| 13 | 23 | 102 | −82 | −8.0 | Ex. 13 |
| 14 | 22 | 100 | −10 | −0.9 | Comp. Ex. 14 |
| 15 | 16 | 82 | −51 | −3.8 | Ex. 15 |
| 16 | 17 | 107 | −92 | −7.5 | Ex. 16 |
| 17 | 17 | 43 | −66 | −2.3 | Comp. Ex. 17 |
| 18 | 14 | 133 | −74 | −9.5 | Ex. 18 |
| 19 | 13 | 178 | −98 | −16.0 | Ex. 19 |
| 20 | 15 | 80 | −20 | −1.3 | Comp. Ex. 20 |
| 21 | 21 | 121 | −80 | −9.5 | Ex. 21 |
| 22 | 17 | 131 | −78 | −10.1 | Ex. 22 |
| 23 | 19 | 90 | −21 | −1.7 | Comp. Ex. 23 |
| 24 | 20 | 35 | −20 | −0.6 | Comp. Ex. 24 |
| 25 | 20 | 65 | −90 | −4.5 | Ex. 25 |
| 26 | 19 | 89 | −87 | −5.3 | Ex. 26 |
| 27 | 16 | 76 | −34 | −1.8 | Comp. Ex. 27 |
| 28 | 12 | 78 | −82 | −4.9 | Ex. 28 |
| 29 | 18 | 68 | −21 | −1.3 | Comp. Ex. 29 |
| 30 | 20 | 97 | −12 | −1.2 | Comp. Ex. 30 |
| 31 | 16 | 23 | −65 | −1.5 | Comp. Ex. 31 |
| 32 | 16 | 62 | −23 | −1.2 | Comp. Ex. 32 |

In the present invention, there is correlation between the toughness and the hole expandability. It was learned that the higher the hole expansion ratio λ, the lower the ductile-brittle transition temperature tends to become. Further, both properties depend on the tensile strength TS, so in the present invention, a hot rolled steel sheet satisfying the following formula 1 was evaluated as being excellent in balance of the toughness and hole expandability.

$$\lambda \times (\text{ductile-brittle transition temperature})/TS \leq -3.0 \quad \text{(formula 1)}$$

As shown in Table 3, it is learned that the hot rolled steel sheets of the examples have tensile strengths of 980 MPa or more and satisfy (formula 1), so are high in strength and excellent in balance of toughness and hole expandability.

In contrast to this, in Comparative Example 2, the average value of the finish rolling temperature was low, so the structural fraction of the martensite phase became less than 10%, in relation to this, the average grain size of the ferrite grains became greater, and, as a result, the toughness fell and the evaluation by (formula 1) was "poor". Further, in Comparative Example 2, not only was the structural fraction of the martensite phase low, but also the contents of elements such as C effective for raising the strength were relatively small, so the tensile strength was less than 980 MPa. In Comparative Example 3, the intermediate air cooling time was short, so the structural fraction of the ferrite phase became less than 60% and the structural fraction of the martensite phase became more than 40%. As a result, the hole expandability fell and the evaluation by (formula 1) was also "poor". In Comparative Example 5, the average value of the finish rolling temperature was high, so the coverage rate of martensite grains by ferrite grains became 60% or less and, as a result, the evaluation by (formula 1) was "poor". In Comparative Example 8, the start temperature of the intermediate air cooling was high, so the structural fraction of the ferrite phase became less than 60% and, as a result, the evaluation by (formula 1) was "poor". In Comparative Example 12, the time from the end of the finish rolling to the start of the forcible cooling was long, so the average grain size of the ferrite grains became more than 5.0 μm and, as a result, the toughness fell and the evaluation by (formula 1) was "poor". In Comparative Example 14, the intermediate air cooling time was long, so the structural fraction of the martensite phase became less than 10%, in relation to this, the average grain size of the ferrite grains became greater, and, as a result, the toughness fell and the evaluation by (formula 1) was also "poor". In Comparative Example 17, the start temperature of the intermediate air cooling was low, so the structural fraction of the ferrite phase was less than 60% and the structural fraction of the martensite phase became more than 40%. As a result, the hole expandability fell and the evaluation by (formula 1) was "poor".

In Comparative Example 20, the average cooling rate of the forcible cooling after the end of the finish rolling was slow, so the structural fraction of the ferrite phase became less than 60% and, as a result, the evaluation by (formula 1) was "poor". In Comparative Example 23, the average cooling rate of the secondary cooling after intermediate air cooling was slow, so a large amount of the bainite phase was formed and a dual structure of the ferrite phase and martensite phase was not obtained. As a result, the evaluation by (formula 1) was "poor". In Comparative Examples 24, 27, 29, and 32, the rolling load of any one of the final three rolling stands was less than 80% of the rolling load of the rolling stand one stand before it, so it was not possible to sufficiently build up the strain required for dynamic recrystallization. For this reason, in these comparative examples, it was not possible to sufficiently achieve the increased fineness of the austenite crystal grains and further the formation of fine ferrite grains accompanying the increase in frequency of formation of ferrite formed from the austenite grain boundaries as nuclei. As a result, the coverage rate of the martensite grains by the ferrite grains fell and the evaluation by (formula 1) was "poor". In Comparative Example 30, the C content was too high, so the toughness fell and the evaluation by (formula 1) was "poor". In Comparative Example 31, the Mn content was too high, so the hole expandability fell and the evaluation by (formula 1) was "poor".

The invention claimed is:

1. A hot rolled steel sheet comprising a composition comprising, by mass %,

C: 0.02% or more and 0.50% or less,
Si: 2.0% or less,
Mn: 0.5% or more and 3.0% or less,
P: 0.1% or less,
S: 0.01% or less,
Al: 0.01% or more and 1.0% or less,
N: 0.01% or less, and
a balance of Fe and impurities, wherein the hot rolled steel sheet comprises a dual structure of, by area fraction, a structural fraction of a martensite phase of 10% or more and 40% or less, and a structural fraction of a ferrite phase of 60% or more, the hot rolled steel sheet has an average grain size of ferrite grains of 5.0 μm or less, the hot rolled steel sheet has a coverage rate of martensite grains by ferrite grains of more than 60%, and wherein the "coverage rate of martensite grains by ferrite grains" is the ratio of length, expressed by percentage, of martensite grain boundary parts occupied by ferrite grains when the total martensite grain boundary length is 100.

2. The hot rolled steel sheet according to claim 1, further comprising, by mass %, one or more of Nb: 0.001% or more and 0.10% or less,
Ti: 0.01% or more and 0.20% or less,
Ca: 0.0005% or more and 0.0030% or less,
Mo: 0.02% or more and 0.5% or less, and
Cr: 0.02% or more and 1.0% or less.

3. The hot rolled steel sheet according to claim 1, wherein the average grain size of the ferrite grains is 4.5 μm or less.

4. The hot rolled steel sheet according to claim 2, wherein the average grain size of the ferrite grains is 4.5 μm or less.

5. The hot rolled steel sheet according to claim 1, wherein the coverage rate is 65% or more.

6. The hot rolled steel sheet according to claim 2, wherein the coverage rate is 65% or more.

7. The hot rolled steel sheet according to claim 3, wherein the coverage rate is 65% or more.

8. The hot rolled steel sheet according to claim 4, wherein the coverage rate is 65% or more.

9. The hot rolled steel sheet according to claim 1, wherein the structural fraction of the martensite phase is 10% or more and less than 20%.

10. The hot rolled steel sheet according to claim 2, wherein the structural fraction of the martensite phase is 10% or more and less than 20%.

11. The hot rolled steel sheet according to claim 3, wherein the structural fraction of the martensite phase is 10% or more and less than 20%.

12. The hot rolled steel sheet according to claim 4, wherein the structural fraction of the martensite phase is 10% or more and less than 20%.

13. The hot rolled steel sheet according to claim 5, wherein the structural fraction of the martensite phase is 10% or more and less than 20%.

14. The hot rolled steel sheet according to claim 6, wherein the structural fraction of the martensite phase is 10% or more and less than 20%.

15. The hot rolled steel sheet according to claim 7, wherein the structural fraction of the martensite phase is 10% or more and less than 20%.

16. The hot rolled steel sheet according to claim 8, wherein the structural fraction of the martensite phase is 10% or more and less than 20%.

17. A method for producing a hot roiled steel sheet comprising:

casting a slab comprising, by mass %

C: 0.02% or more and 0.50% or less,
Si: 2.0% or less,
Mn: 0.5% or more and 3.0% or less,
P: 0.1% or less,
S: 0.01% or less,
Al: 0.01% or more and 1.0% or less,
N: 0.01% or less, and
a balance of Fe and impurities, hot rolling the cast slab wherein the hot rolling includes finish rolling the slab using a rolling mill provided with at least four consecutive rolling stands, the respective rolling loads of the final three rolling stands in the finish rolling are 80% or more of a rolling load of an immediately previous rolling stand, and an average value of finish rolling temperatures of the final three rolling stands is 800° C. or more and 950° C. or less, and forcibly cooling, then coiling the finish rolled steel sheet wherein the forcibly cooling includes primary cooling started within 1.5 seconds after the finish rolling ends and cooling the steel sheet by a 30° C./second or more average cooling rate down to 600°

C. or more and 750° C. or less, intermediate air cooling allowing the primary cooled steel sheet to naturally cool for 3 seconds or more and 10 seconds or less, and secondary cooling the intermediate air cooled steel sheet by a 30° C./second or more average cooling rate down to 200° C. or less, thereby producing the hot rolled steel sheet according to claim 7.

* * * * *